US006840829B2

(12) United States Patent
Matsuda et al.

(10) Patent No.: US 6,840,829 B2
(45) Date of Patent: Jan. 11, 2005

(54) JET-PROPULSION WATERCRAFT

(75) Inventors: Yoshimoto Matsuda, Hyogo (JP); Hironori Tomari, Hyogo (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 0 days.

(21) Appl. No.: 10/232,201

(22) Filed: Aug. 30, 2002

(65) Prior Publication Data

US 2004/0018786 A1 Jan. 29, 2004

Related U.S. Application Data

(63) Continuation-in-part of application No. 10/207,499, filed on Nov. 1, 2002, now abandoned.

(51) Int. Cl.[7] ..... B63H 21/10
(52) U.S. Cl. ..... 440/88 L; 440/88 C
(58) Field of Search ..... 440/88 R, 88 L, 440/88 HE, 88 C, 88 D, 38; 123/196 AB; 184/104.3; 165/154, 41, 42, 916

(56) References Cited

U.S. PATENT DOCUMENTS 2,466,525 A * 4/1949 Harrison ..... 165/282
3,990,424 A * 11/1976 Miersch et al. ..... 123/196 AB
4,641,615 A * 2/1987 Ferguson ..... 123/196 AB
4,685,430 A * 8/1987 Ap ..... 123/142.5 R
4,896,718 A * 1/1990 Trin ..... 165/141
5,004,042 A * 4/1991 McMorries et al. ..... 165/41
5,522,453 A * 6/1996 Green ..... 165/41
5,848,636 A * 12/1998 Chuang ..... 165/74
5,885,121 A * 3/1999 Nanami et al. ..... 440/88 R
6,015,320 A * 1/2000 Nanami ..... 440/88 L
6,036,556 A * 3/2000 Baker et al. ..... 440/38
6,105,664 A * 8/2000 Gillbrand et al. ..... 165/119
6,263,960 B1 * 7/2001 Yamanaka et al. ..... 165/119
6,346,019 B1 * 2/2002 Nanami ..... 440/89 R
6,454,621 B2 * 9/2002 Matsuda ..... 440/88 R
6,478,644 B1 * 11/2002 Ozawa et al. ..... 440/89 R
6,497,596 B1 * 12/2002 Nanami ..... 440/88 R
6,524,149 B1 * 2/2003 Hattori ..... 440/88 R
6,530,336 B2 * 3/2003 Ibata et al. ..... 114/55.5
6,554,664 B1 * 4/2003 Nanami ..... 440/88 J

* cited by examiner

*Primary Examiner*—Andrew Wright
(74) *Attorney, Agent, or Firm*—Marshall, Gerstein & Borun LLP

(57) ABSTRACT

A jet-propulsion watercraft comprises: an engine; an oil tank provided independently of the engine, for reserving engine oil; and a water jet pump driven by the engine, the water jet pump pressurizing and accelerating water taken in from outside of the watercraft and ejecting the water from the outlet port to propel the watercraft as a reaction of the ejecting water, and the muffler is provided behind the engine and on one of right and left sides of the watercraft and the oil tank is provided behind the engine and on the other side of the watercraft.

13 Claims, 6 Drawing Sheets

(Fig. 3)

JET-PROPULSION WATERCRAFT

CROSS-REFERENCE TO RELATED APPLICATION

This application is a continuation-in-part of application Ser. No. 10/207,499 filed Nov. 1, 2002 now abandoned.

BACKGROUND OF THE INVENTION

1. Field of the Invention

The present invention relates to a jet-propulsion watercraft including a personal watercraft (PWC) which ejects water rearward and planes on a water surface as the resulting reaction. More particularly, the present invention relates to an oil tank of the jet-propulsion watercraft.

2. Description of the Related Art

In recent years, so-called jet-propulsion personal watercraft have been widely used in leisure, sport, rescue activities, and the like. The jet-propulsion personal watercraft is configured to have a water jet pump that pressurizes and accelerates water sucked from a water intake generally provided on a bottom of a hull and ejects it rearward from an outlet port. Thereby, the personal watercraft is propelled.

In the jet-propulsion personal watercraft, a steering nozzle provided behind the outlet port of the water jet pump is swung either to the right or to the left, to change the ejection direction of the water to the right or to the left, thereby turning the watercraft to the right or to the left.

In a generalized configuration of the personal watercraft, a straddle-type seat is provided to span between substantially the center portion and the rear portion in the longitudinal direction of the watercraft and an engine is contained in an engine room located beneath the seat and surrounded by a hull and a deck. A crankshaft of the engine projects rearwardly in the longitudinal direction and its rear end is coupled to a pump shaft of the water pump, thereby driving the water jet pump. The engine is a two-cycle engine.

In recent years, the use of a four-cycle engine in place of the two-cycle engine has been contemplated. The use of the four-cycle engine requires an oil tank for reserving engine oil (hereinafter simply referred to as oil).

In the personal watercraft provided with the straddle-type seat, the height of the engine is restricted by the vertical position of the straddle-type seat. Nonetheless, the use of the four-cycle engine in place of the two-cycle engine increases the height of cylinder heads due to its valve mechanism. In addition, since an oil pan for reserving oil is provided below a crankcase, the height of the engine is increased.

Also, the temperature of the exhaust gas is higher in the four-cycle engine than in the two-cycle engine. Therefore, cooling performance of the entire engine, including auxiliary machinery, needs to be enhanced.

Further, in the case of the watercraft, front-and-rear weight balance of the watercraft becomes important so that the watercraft can quickly enter a desired planing state. The oil needs to be smoothly supplied to the engine during the planing state in which an oil circulation amount is increased.

Moreover, in a small watercraft, right-and-left weight balance of the watercraft can be taken into account, because of its small width.

SUMMARY OF THE INVENTION

The present invention addresses the above-described condition, and an object of the present invention is to provide a jet-propulsion watercraft in which an oil tank is placed and structured in a suitable manner when a four-cycle engine is mounted in the watercraft.

According to the present invention, there is provided a jet-propulsion watercraft comprising: an engine; an oil tank provided independently of the engine, for reserving engine oil; and a water jet pump driven by the engine, the water jet pump pressurizing and accelerating water taken in from outside of the watercraft and ejecting the water from the outlet port to propel the watercraft as a reaction of the ejecting water, wherein the muffler is provided behind the engine and on one of right and left sides of the watercraft and the oil tank is provided behind the engine and on the other side of the watercraft.

In the jet-propulsion watercraft, since the muffler is provided behind the engine and on one of right and left sides of the watercraft and the oil tank is provided behind the engine and on the other side of the watercraft, weight and arrangement on right and left sides of the watercraft are properly in balance. In addition, the oil tank and the muffler can be compactly placed in the watercraft.

Preferably, the oil tank is provided such that its longitudinal direction corresponds with a vertical direction. Thereby, the oil tank is less susceptible to lateral acceleration while the watercraft is turning, because the oil tank is placed such that its longitudinal direction corresponds with the vertical direction. In addition, air contained in the oil is satisfactorily separated. Consequently, the oil can be smoothly supplied to the engine.

The oil tank may be provided with an inner tube inside of the oil tank to form a vertically long closed space in the oil tank and cooling water is led into the closed space for water-cooling the oil tank. Thereby, the water from the water jet pump can be used for cooling the oil in the tank with a compact constitution.

An outer plate of the muffler and an outer plate of the oil tank may be identical components, and/or an end plate of the muffler and an end plate of the oil tank may be identical components. These components are manufactured by using one metal mold, and mass production effects are produced, which leads to a decreased manufacturing cost and easy stock control.

The jet-propulsion watercraft may be a personal watercraft configured such that a straddle-type seat is provided to span between a center portion of a body and a rear portion of the body, a steering handle is provided in front of the seat, and the engine is mounted in a space below the seat. This constitution is suitable for the personal watercraft having a narrow inner space.

According to the present invention, there is also provided a jet-propulsion watercraft comprising: an engine; an oil tank provided independently of the engine, for reserving engine oil; and a water jet pump driven by the engine, the water jet pump pressurizing and accelerating water taken in from outside of the watercraft and ejecting the water from the outlet port to propel the watercraft as a reaction of the ejecting water, wherein the oil tank is provided with a cooling water passage, and the engine oil reserved in the oil tank is cooled by water being supplied from the water jet pump to the cooling water passage. This makes it possible that the engine oil can be effectively cooled in a simple manner even when the engine and the oil tank are provided in a limited closed space of the watercraft.

It is preferable that the oil tank is tubular and is provided with an inner tube inside of the oil tank as the cooling water passage. Thereby, the engine oil in the tank can be cooled with a simple structure.

The oil tank may be cylindrical and the oil tank and the inner tube may be provided such that their longitudinal directions correspond with a vertical direction. Thereby, the oil can be smoothly supplied to the engine side while the watercraft is turning because the oil tank is less susceptible to lateral acceleration.

A breather pipe may be provided inside of the inner tube such that a base end of the breather pipe is connected to an oil reserving portion formed between the inner tube and an inner face of the oil tank. Since the breather pipe can be contained in the oil tank, the oil tank and its vicinity are visually favorable.

The base end of the breather pipe may be located at an upper end portion of the oil tank, and the breather pipe may extend downwardly to a bottom of the inner tube, from which the breather pipe may extend upwardly, and a tip end of the breather pipe may protrude from an upper end of the oil tank. Thereby, even when the watercraft is inverted, oil leakage from the oil tank can be prevented. Besides, the water-cooled oil tank adapted to introduce the cooling water into the inner space is attained.

A separating plate may be provided in an oil reserving portion formed between the inner tube and an inner face of the oil tank such that the separating plate extends radially outwardly from an outer peripheral face of the inner tube.

This stabilizes the oil in the oil tank and prevents bubbles from being mixed with the oil regardless of pitching pr rolling of the watercraft. Also, since the separating plate functions as a cooling fin, the oil in the tank can be more effectively cooled.

An oil introducing pipe of the oil tank may be provided so as to be offset from a center axis of the oil tank. Since the oil introduced into the oil tank is swirling inside of the tank, the air can be quickly separated from the oil containing bubbles which is returned from the engine into the oil tank, by centrifugation generated by placement of the oil inlet. Besides, the oil can be more effectively cooled.

The jet-propulsion watercraft may be a personal watercraft configured such that a straddle-type seat is provided to span between a center portion of a body and a rear portion of the body, a steering handle is provided in front of the seat, and the engine is mounted in a space below the seat. This constitution is suitable to the personal watercraft having a narrow inner space.

According to the present invention, there is further provided a jet-propulsion watercraft comprising: an engine; an oil tank provided independently of the engine, for reserving engine oil; and a water jet pump driven by the engine, the water jet pump pressurizing and accelerating water taken in from outside of the watercraft and ejecting the water from the outlet port to propel the watercraft as a reaction of the ejecting water, wherein the oil tank is tubular and is provided such that its longitudinal direction corresponds with a vertical direction, and the oil tank is provided at an upper portion with an inlet through which engine oil from the engine flows into the oil tank and at a lower portion with an outlet through which the engine oil to the engine flows to outside of the oil tank, wherein the inlet is provided on a side wall of the oil tank such that the inlet is offset from a center axis of the oil tank to allow the engine oil flowing into the oil tank to swirl.

Thereby, since the oil introduced into the oil tank is swirling inside of the tank, the air can be quickly separated from the oil by centrifugation. Besides, the oil can be more effectively cooled.

It is preferable that the oil tank is cylindrical and the inlet is provided in a side face of the oil tank so as to be oriented along a tangential direction of the side face. This generates centrifugation more effectively, so that the air is separated from the oil and the oil is cooled more effectively.

A separating plate may be provided inside of the oil tank such that the separating plate is orthogonal to the center axis of the oil tank. This makes it possible that the air can be separated from the oil more effectively.

The oil tank may be provided with an inner tube inside of the oil tank in which water from the water jet pump flows. This makes it possible that the oil can be cooled effectively.

The jet-propulsion watercraft may be a personal watercraft configured such that a straddle-type seat is provided to span between a center portion of a body and a rear portion of the body, a steering handle is provided in front of the seat, and the engine is mounted in a space below the seat. This constitution is suitable to the personal watercraft having a narrow inner space.

The above and further objects and features of the invention will be more fully be apparent from the following detailed description with accompanying drawings.

DETAILED DESCRIPTION OF THE PREFERRED EMBODIMENTS

Hereinafter, a personal watercraft which is one type of a jet-propulsion watercraft according to an embodiment of the present invention will be described with reference to the accompanying drawings.

Figure 1:
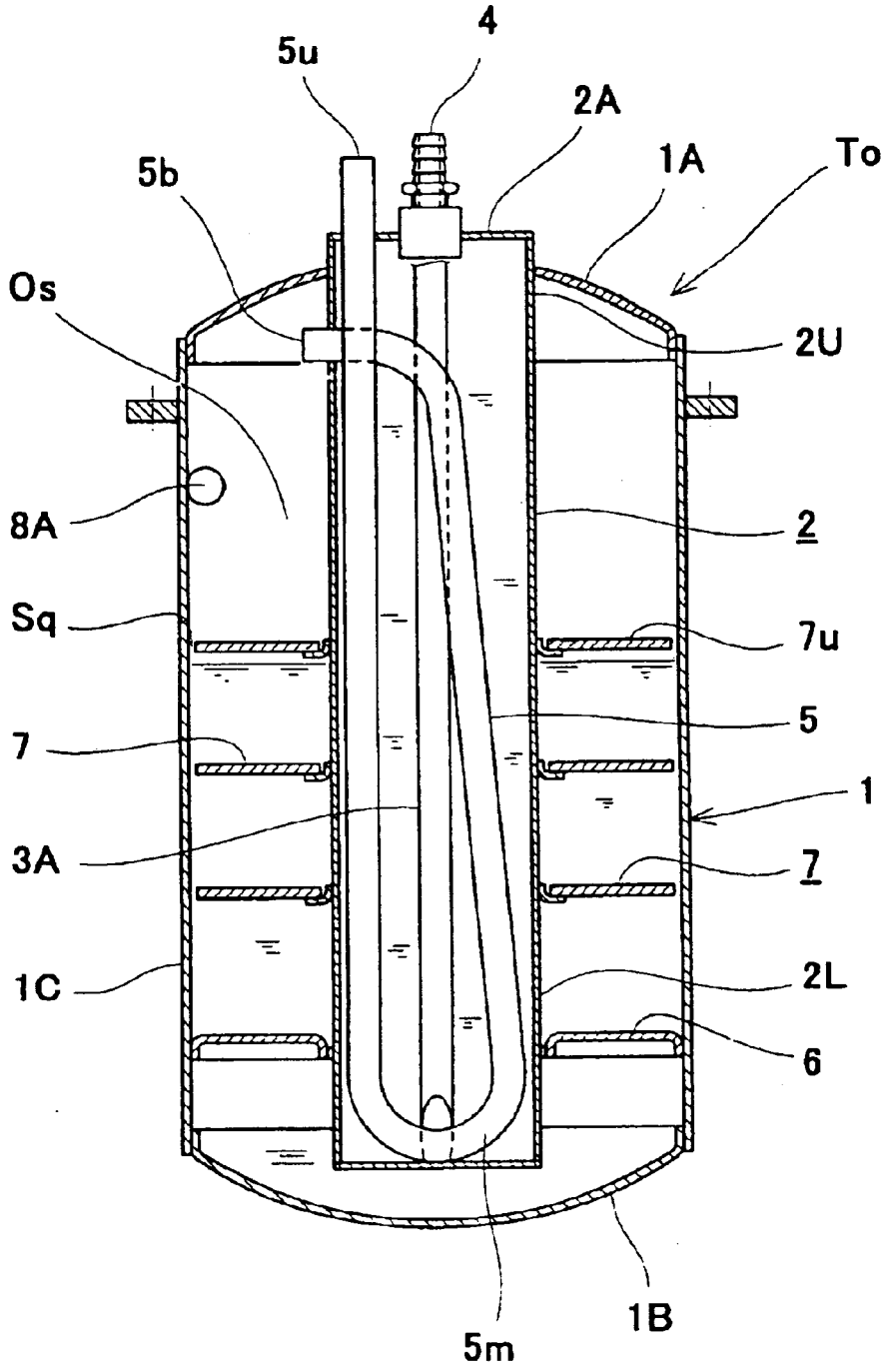
FIG. 1 is a side sectional view showing a structure of an oil tank of a personal watercraft according to an embodiment of the present invention.
Figure 2:
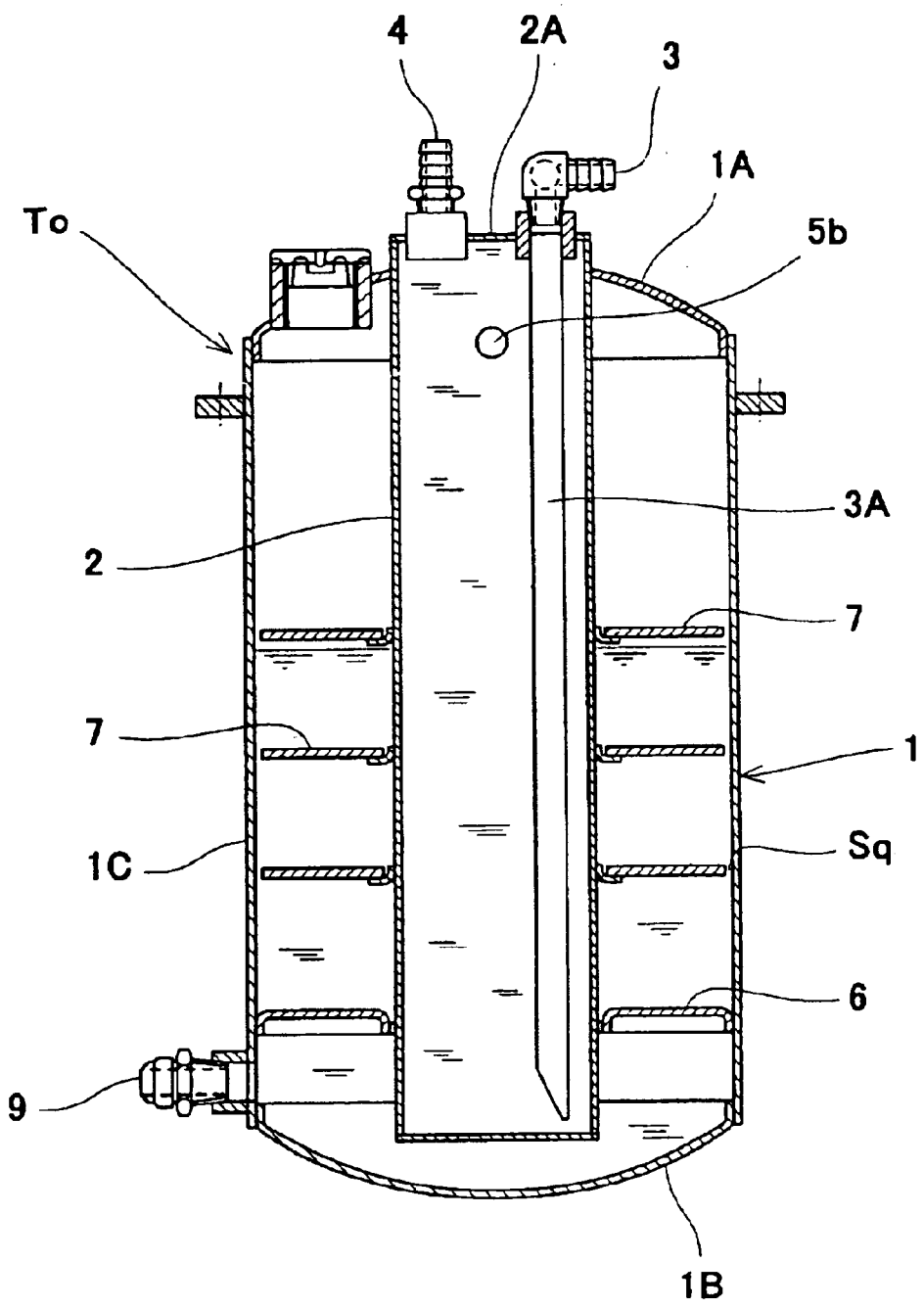
FIG. 2 is a front sectional view of the oil tank in FIG. 1.
Figure 3:
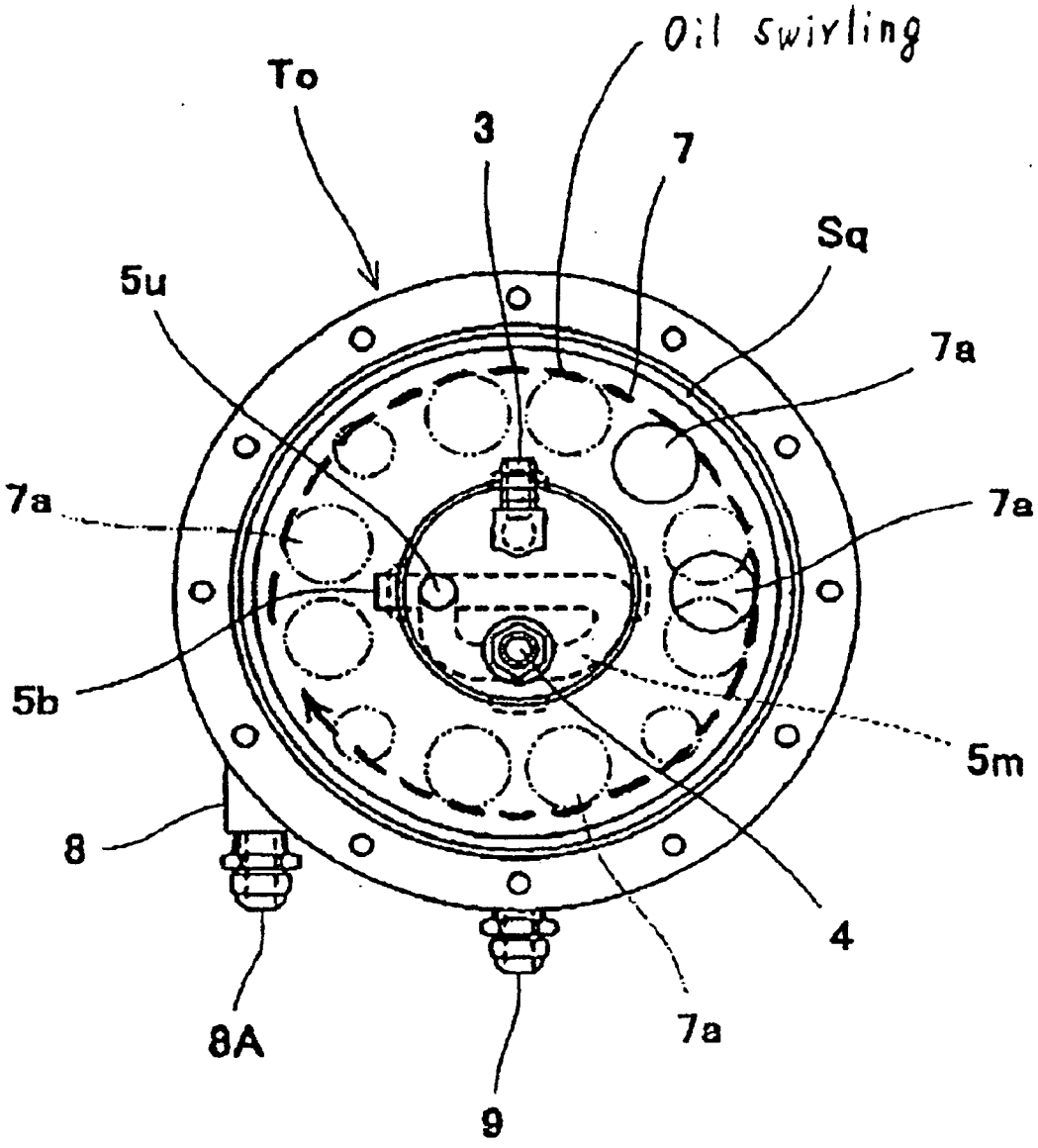
FIG. 3 is a plan view showing the state in which an end plate at an upper end of the oil tank in FIGS. 1, 2 is removed.
Figure 4:
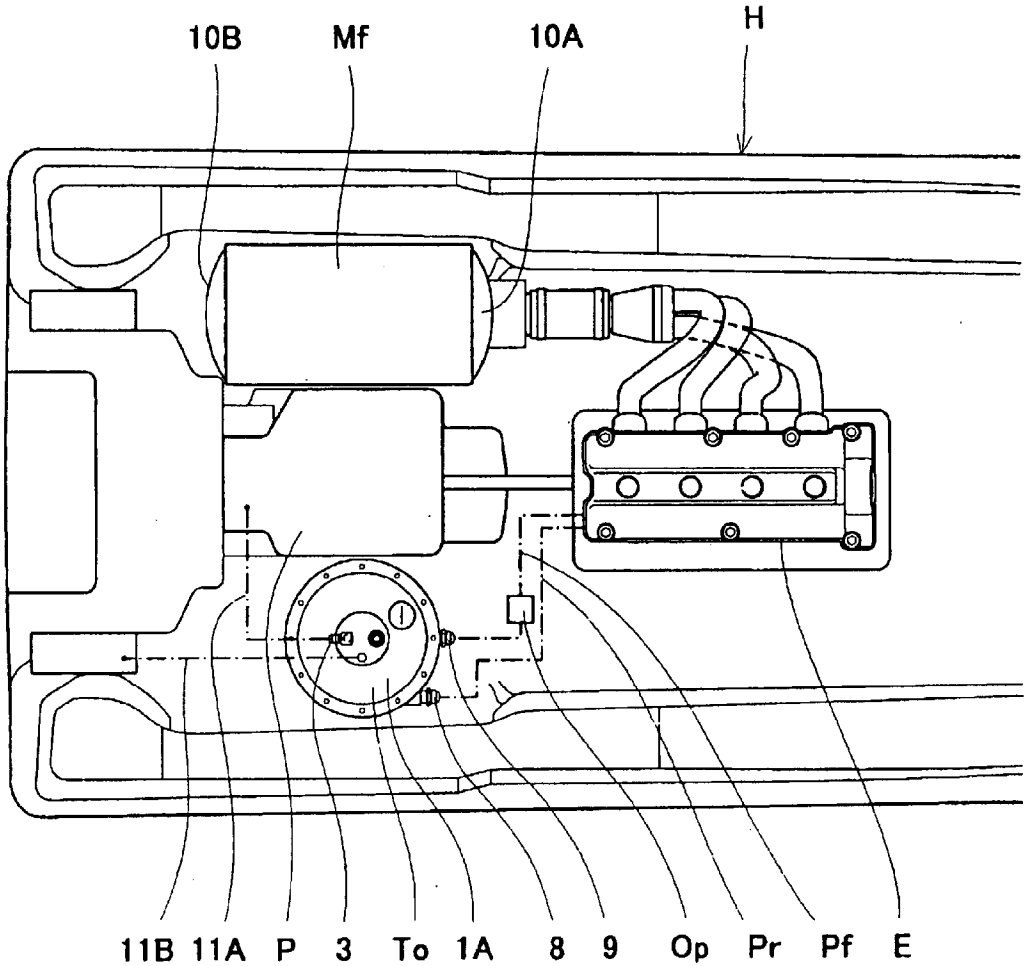
FIG. 4 is a plan view of a cut away deck portion of the watercraft, showing placement of the oil tank in FIGS. 1–3 in the personal watercraft.
Figure 5:
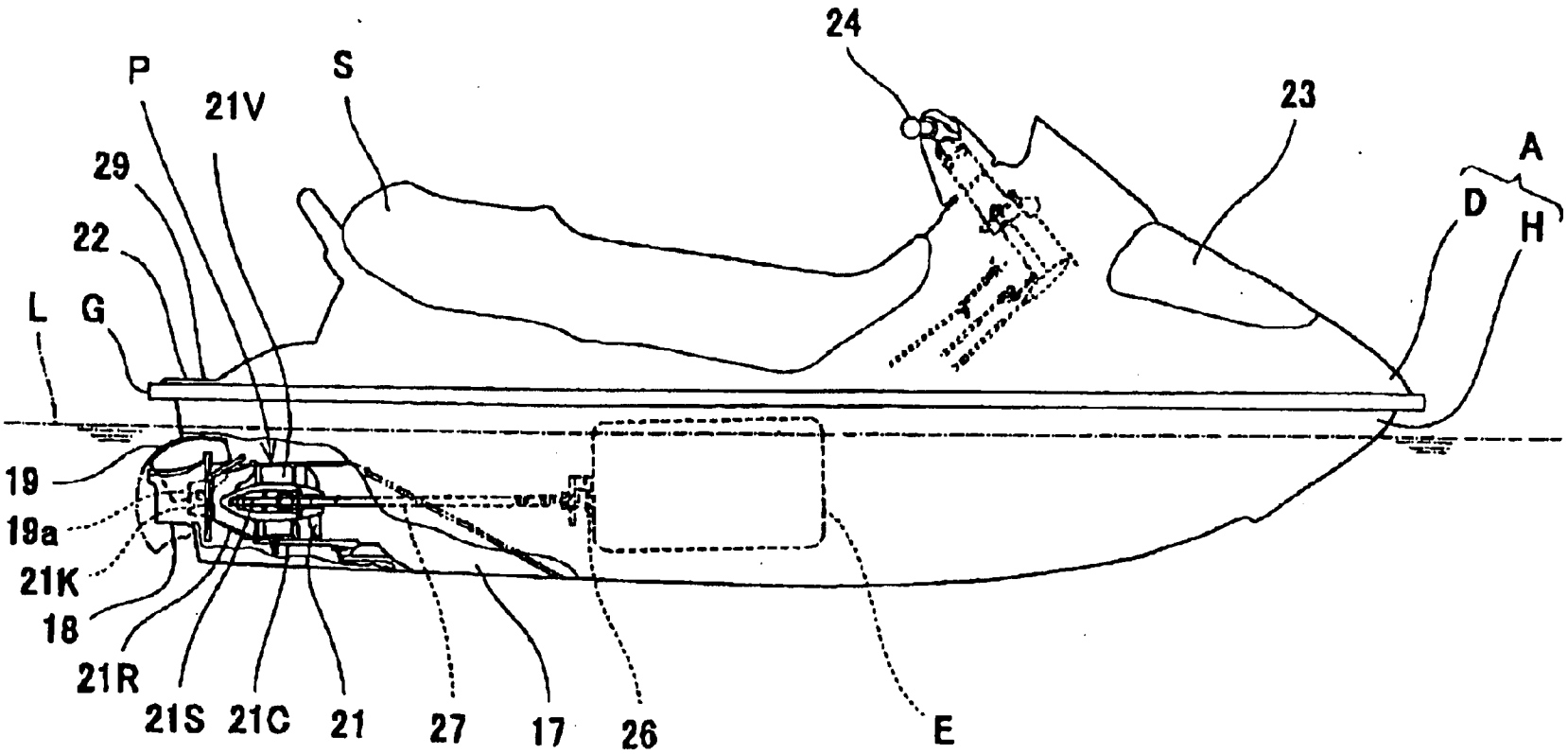
FIG. 5 is side view showing an entire jet-propulsion personal watercraft according to the embodiment of the present invention.
Figure 6:
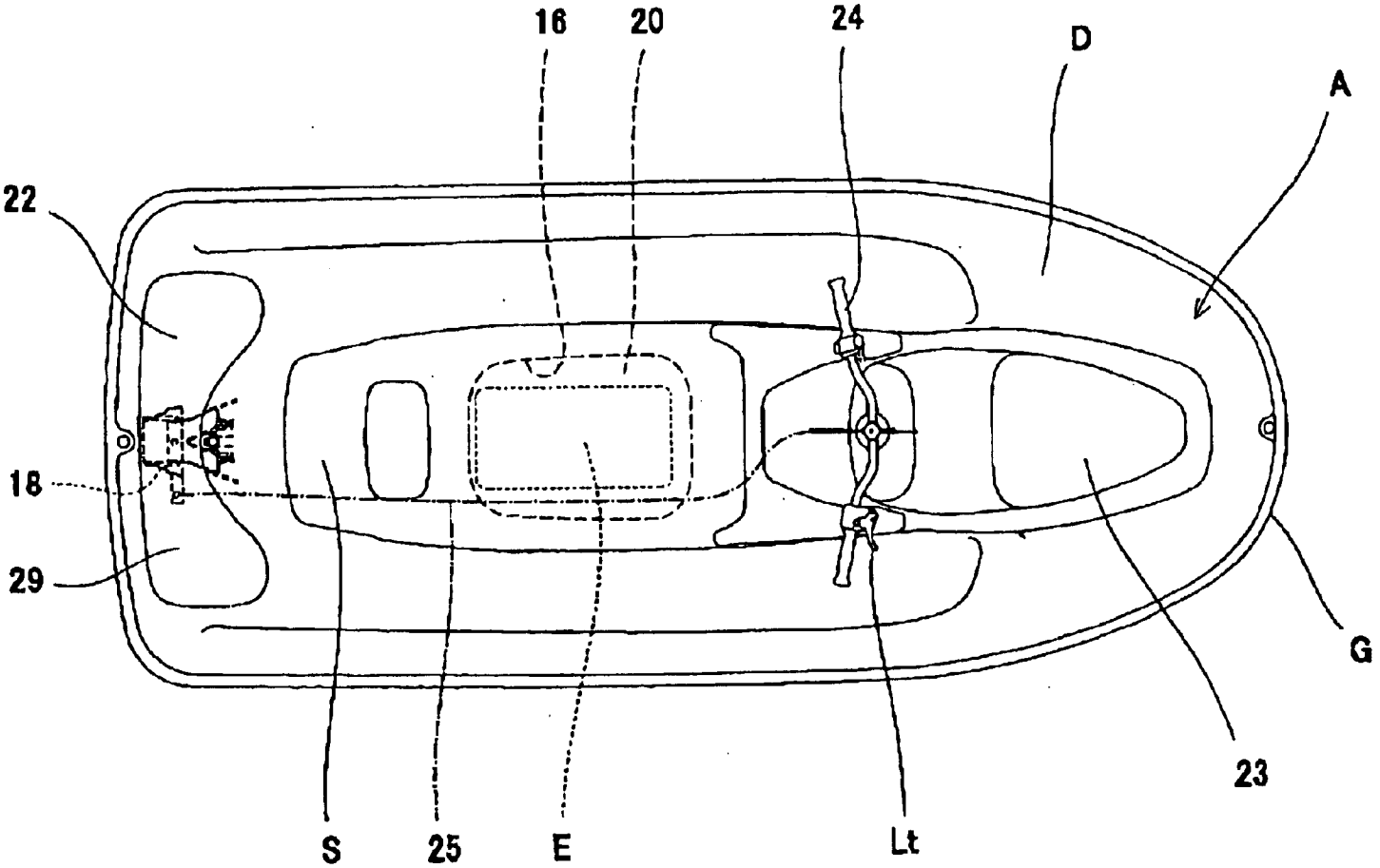
FIG. 6 is a plan view showing the entire personal watercraft in FIG. 5.

FIG. 1 is a longitudinal side-sectional view showing a constitution of a personal watercraft according to an embodiment of the present invention. FIG. 2 is a front sectional view of an oil tank in FIG. 1. FIG. 3 is a plan view showing the state in which an end plate at an upper end of an oil tank is removed. FIG. 4 is a plan view of a cut away deck portion of the watercraft, showing arrangement of the oil tank in FIGS. 1–3 in the personal watercraft. FIG. 5 is side view showing an entire jet-propulsion personal watercraft according to the embodiment of the present invention. FIG. 6 is a plan view showing the entire personal watercraft in FIG. 5.

In FIGS. 5, 6, reference numeral A denotes a body of the personal watercraft. The body A comprises a hull H and a deck D covering the hull H from above. A line at which the hull H and the deck D are connected over the entire perimeter thereof is called a gunnel line G. In this embodiment, the gunnel line G is located above a waterline L of the personal watercraft.

As shown in FIG. 6, an opening 16, which has a substantially rectangular shape seen from above, is formed at a relatively rear section of the deck D such that it extends in the longitudinal direction of the body A. As shown in FIGS. 5, 6, a riding seat S is provided over the opening 16.

An engine E is provided in a chamber (engine room) 20 surrounded by the hull H and the deck D below the seat S.

The engine E is a four-cycle dry sump type engine of a multi-cylinder (e.g., four-cylinder). As shown in FIG. 5, a crankshaft 26 of the engine E is mounted along the longitudinal direction of the body A. An output end of the crankshaft 26 is rotatably coupled integrally with a pump shaft 21S of a water jet pump P through a propeller shaft 27. An impeller 21 is attached on the pump shaft 21S of the water jet pump P. The impeller 21 is covered with a pump casing 21C on the outer periphery thereof. A water intake 17 is provided on the bottom of the hull H. The water is sucked from the water intake 17 and fed to the water jet pump P through a water intake passage. The water jet pump P pressurizes and accelerates the water by rotation of the impeller 21. The pressurized and accelerated water is discharged through a pump nozzle 21R having a cross-sectional area of flow gradually reduced rearward, and from an outlet port 21K provided on the rear end of the pump nozzle 21R, thereby obtaining the propulsion force.

In FIG. 5, reference numeral 21V denotes fairing vanes for fairing water flow behind the impeller 21. As shown in FIGS. 5, 6, reference numeral 24 denotes a bar-type steering handle. The handle 24 operates in association with a steering nozzle 18 swingable around a swing shaft (not shown) to the right or to the left behind the pump nozzle 21R. When the rider rotates the handle 24 clockwise or counterclockwise, the steering nozzle 18 is swung toward the opposite direction so that the watercraft can be correspondingly turned to any desired direction while the water jet pump P is generating the propulsion force. As shown in FIG. 6, the handle 24 is provided with a throttle lever Lt for controlling an engine speed of the engine E in the vicinity of a right grip.

As shown in FIG. 5, a bowl-shaped reverse deflector 19 is provided above the rear side of the steering nozzle 18 such that it can swing downward around a horizontally mounted swinging shaft 19*a*. The deflector 19 is swung downward to a lower position behind the steering nozzle 18 to deflect the ejected water from the steering nozzle 18 forward, and as the resulting reaction, the personal watercraft moves rearward.

In FIGS. 5, 6, reference numeral 22 denotes a rear deck. The rear deck 22 is provided with an openable rear hatch cover 29. A rear compartment (not shown) with a small capacity is provided under the rear hatch cover 29. In FIG. 5 or 6, reference numeral 23 denotes a front hatch cover. A front compartment (not shown) is provided under the front hatch cover 23 for storing equipments and the like.

As shown in FIG. 4, in the personal watercraft according to the embodiment of the present invention, an oil tank To is provided independently of the engine E. The oil tank To is vertically provided behind the engine E on the right side (starboard) of the personal watercraft such that its longitudinal direction corresponds with the vertical direction. A water muffler Mf is provided behind the engine E on the left side (port) of the watercraft such that the water muffler Mf and the oil tank To are symmetric with respect to the water jet pump P. The oil tank To is located above a planing surface while the watercraft is planing on the water surface.

As shown in FIGS. 1–3, the oil tank To is entirely cylindrical and provided at end faces with substantially bowl-shaped end plates 1A, 1B, the centers of which are outwardly protruded. Between the upper and lower end plates 1A, 1B, a body portion 1C formed by curving a plate member in the form of a cylinder is provided. Both ends of the body portion 1C are respectively welded to the end plates 1A, 1B, thereby forming a closed space inside thereof. The body portion 1C and the end plates 1A, 1B constitute an outer shell 1 of the oil tank To.

An inner tube 2 vertically extends inside of the oil tank To, to be precise, in the center portion of the oil tank To. The end plate 1A has an opening at its center portion. The inner tube 2 upwardly protrudes from the end plate 1A through the opening. An upper end portion 2U of the inner tube 2 is welded and fixed to the end plate 1A and a lower end portion 2L of the inner tube 2 is welded and fixed to an inner peripheral face of the body portion 1C of the oil tank To through a fixed bracket.

Both end faces of the inner tube 2 are closed, thereby forming a closed container. A cooling water inlet 3 is provided at an upper end face 2A of the inner tube 2 and a leading pipe 3A extends from the cooling water inlet 3 to the lower end of the inner tube 2 inside the inner tube 2. A cooling water outlet 4 is provided at the end face 2A adjacently to the cooling water inlet 3. A breather pipe S for the oil tank To is provided inside of the inner tube 2. A base end 5*b* of the breather pipe 5 protrudes radially outwardly from an outer peripheral face of the inner tube 2 and is opened at an upper portion of an oil reserving portion Os formed between the inner tube 2 and the outer shell 1. An intermediate portion 5*m* of the breather pipe 5 extends downwardly from the base end 5*b*, is folded back at the bottom of the inner tube 2, and extends upwardly. A tip end Su of the breather pipe S protrudes upwardly from the upper end face 2A of the inner tube 2 and is opened to ambient side. That is, the oil tank To has a double-tube structure, in which the inner tube 2 is contained in the oil tank To forming the closed space and forms another closed space in the oil tank To.

As shown in FIGS. 1, 2, ring-shaped separating plates 7 are arranged in multiple stages in the vertical direction in the oil tank To such that they extend radially outwardly from the outer peripheral face of the inner tube 2. A gap Sq is formed between each of the separating plates 7 and the inner peripheral face of the outer shell 1 of the oil tank To, and as shown in FIG. 3, penetrating holes 7*a* are formed in each of the separating plates 7 to allow the oil to circulate in the vertical direction.

As shown in FIG. 1, an oil inlet 8A is provided at the upper end portion of the oil tank To, to be specific, at a position slightly lower than the base end 5*b* of the breather pipe 5 and above the separating plate 7*u* in the highest stage. Also, as shown in FIG. 3, the oil inlet 8A is offset from the center axis of the oil tank To. To be specific, the oil tank To is provided with an oil introducing pipe 8 having the oil inlet 8A at the tip end such that the longitudinal direction of the oil introduction pipe 8 substantially corresponds with the tangential direction of the oil tank To.

The oil tank To is provided with an oil outlet 9 shown in FIGS. 2, 3 at a lower portion of the oil tank To, i.e., below the fixed bracket 6, to allow the oil to be supplied from the oil tank To to the engine E.

As shown in FIG. 4, the oil tank To is placed such that the oil inlet 8A and the oil outlet 9 are located on the front side of the watercraft. The oil inlet 8 communicates with the engine E through an oil return pipe Pr. The oil outlet 9 communicates with the engine E through an oil supply pipe Pf in which an oil supply pump Op is provided. Therefore, oil is circulated between the oil tank To and the engine E through the oil return pipe Pr and the oil supply pipe Pf In this embodiment, the oil pump Op is provided independently of the oil tank To. Alternatively, the oil pump Op may be built in the oil tank To or the oil pump Op may be built in the engine E.

In this embodiment, to meet specific requirements of mass production and productivity, or the like, the end plates 1A, 1B of the oil tank To, and end plates 10A, 10B provided at the front and rear ends of the water muffler Mf are identical components. Also, the body as the outer plate of the oil tank To and the body as the outer plate of the water muffler Mf may be identical components.

As shown in FIG. 4, the cooling water is supplied from the water jet pump P to the cooling water inlet 3 of the inner tube 2 through a cooling water supply passage 11A, and the cooling water which has cooled the inside of the oil tank To, is discharged from the cooling water outlet 4 in the inner tube 2 outside the watercraft through a cooling water discharge passage 11B.

Since the oil tank To and the muffler Mf are provided behind the engine E, and are respectively provided on one of right and left sides and the other side of the watercraft 1, the weight and arrangement on the right and left sides of the watercraft 1 are properly in balance.

The oil is introduced from the engine E side into the oil tank To through the oil inlet 8A. Inside the oil tank, the oil is swirling along the wall surface of the body of the oil tank To. As a result, the air contained in the oil is separated. Also, since the oil is hardly affected by oscillation of the oil tank To while being led downwardly through the penetrating holes 7*a* and the gaps Sq in the separating plates 7 provided in multiple stages inside of the oil tank To, the air remaining in the oil is gradually separated from the oil.

While the watercraft is shaking during planing on the water surface, the separating plates 7 serve to prevent vertical oscillation of the oil in the oil tank To caused by the shaking, thereby stably supplying the oil into the engine E, and preventing the air ingress into the oil The oil is cooled by the cooling water supplied into the inner tube 2 from the inside of the oil tank To. Such cooling facilitates separation of the air remaining in the oil.

Since the oil tank To is vertically placed such that its longitudinal direction corresponds with the vertical direction, the oil in the oil tank To is less susceptible to lateral acceleration being applied while the watercraft is turning. Therefore, even under such condition, the oil can be stably supplied to the engine E.

The air separated from the oil in the oil tank To can be easily discharged outside through the breather pipe 5. In addition, even when the watercraft is inverted, leakage of the oil from the oil tank To can be prevented because the breather pipe 5 is upwardly folded back at the intermediate portion 5*m*.

While the inner tube 2 is provided inside of the oil tank To and the cooling water being supplied from the water jet pump is led into the inner tube in this embodiment, a cooling water passage may be provided in an outer peripheral portion of the oil tank To. This makes it possible that the temperature of the outer periphery of the oil tank To can be reduced as well.

Numerous modifications and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

What is claimed is:

1. A jet-propulsion watercraft comprising:

an engine;

an oil tank provided independently of the engine, for reserving engine oil, said oil tank having an outer shell comprised of an elongated tubular body portion and end plates configured to close both ends of the body portion so as to form a closed outer space inside thereof to reserve the engine oil, and the oil tank is provided such that its longitudinal direction corresponds with a vertical direction;

a water jet pump driven by the engine, the water jet pump pressurizing and accelerating water taken in from outside of the watercraft and ejecting the water from the outlet port to propel the watercraft as a reaction of the ejecting water; and a muffler of the engine, wherein the oil tank and the muffler are provided at respective locations, within an inner space of a hull of the watercraft, behind the engine and on opposite sides of the water-jet pump in a lateral direction of the watercraft such that the water-jet pump is disposed between the oil tank and the muffler.

2. The jet-propulsion watercraft according to claim 1, wherein the oil tank is provided with an elongated inner tube inside of the outer shell, a closed space is formed within the inner tube, the engine oil is reserved in a space formed between the outer shell and the inner tube, and cooling water is led into the closed space within the inner tube for water-cooling the engine oil.

3. The jet-propulsion watercraft according to claim 3, wherein:

an inlet and an outlet of the engine oil are provided as to communicate with the space between the outer shell and the inner tube, the inlet of the engine oil is provided at an upper portion of the tubular body portion of the outer shell, and the outlet of the engine oil is provided at a lower portion of the tubular body portion of the outer shell.

4. The jet-propulsion watercraft according to claim 1, wherein the muffler has the outer shell, and the outer shell of the muffler and the outer shell of the oil tank are identical components.

5. A jet-propulsion watercraft comprising:

an engine;

an oil tank provided outwardly of and separately from the engine, for reserving engine oil; and a water jet pump driven by the engine, the water jet pump pressurizing and accelerating water taken in from outside of the watercraft and ejecting the water from the outlet port to propel the watercraft as a reaction of the ejecting water, wherein the oil tank has a tubular outer shell with both ends closed, the outer shell has a center axis and a side wall surrounding the center axis, the oil tank is provided with an inner tube within which a closed space is formed, a space between the outer shell and the inner tube forms an oil reserving portion, wherein an inlet and an outlet of the cooling water are provided on an upper end wall of the closed space of the inner tube, a leading pipe connected to the inlet of the cooling water extends from the inlet of the cooling water to a vicinity of a lower end of the closed space and opens in the vicinity of the lower end, the outlet of the cooling water opens in the vicinity of an upper end of the closed space, and the engine oil reserved in the oil reserving portion is cooled by a cooling water which is supplied from the water-jet pump and flows through the closed space within the inner tube, and wherein the outer shell is cylindrical and the outer shell and the inner tube are provided such that their longitudinal directions correspond with a vertical direction.

6. A jet-propulsion watercraft comprising:

an engine;

an oil tank provided independently of the engine, for reserving engine oil; and a water jet pump driven by the engine, the water jet pump pressurizing and accelerating water taken in from outside of the watercraft and ejecting the water from the outlet port to propel the watercraft as a reaction of the ejecting water, wherein the oil tank includes an outer shell, an oil inlet, and an oil outlet, wherein the outer shell has a tubular side wall and a pair of end walls that close both ends of the tubular side wall, the side wall of the outer shell having a center axis extending in a vertical direction, the oil inlet is provided at an upper portion of the side wall of the outer shell to allow engine oil from the engine to be discharged into the outer shell therethrough, and the oil outlet is provided at a lower portion of the side wall of the outer shell to allow the engine oil to flow out to the engine therethrough, and the oil inlet is provided on the side wall of the outer shell to be offset from the center axis and an opening portion of the oil inlet into the outer shell is provided to be substantially perpendicular to the center axis of the side wall to allow the engine oil discharged from the oil inlet to swirl around the center axis within the outer shell.

7. The jet-propulsion watercraft according to claim 6, wherein the outer shell is provided with an inner tube within which a closed space is formed, a space between the outer shell and the inner tube forms an oil reserving portion, and the engine oil reserved in the oil reserving portion is cooled by a cooling water which is supplied from the water-jet pump and flows through the closed space within the inner tube, and a separating plate is provided in the oil reserving portion such that the separating plate extends radially outwardly from an outer peripheral face of the inner tube to a vicinity of the side wall of the outer shell and has a gap between a tip end of the separating plate and an inner surface of the outer shell.

8. The jet-propulsion watercraft according to claim 6, wherein the oil tank is cylindrical and the oil inlet is provided on the side wall of the oil tank so as to be oriented along a tangential direction of the side wall, as seen from the axial direction of the center axis of the outer shell of the oil tank.

9. The jet-propulsion watercraft according to claim 8, wherein a separating plate is provided inside of the oil tank such that the separating plate is orthogonal to the center axis of the oil tank and has a gap between a tip end of the separating plate and the inner surface of the oil tank.

10. The jet-propulsion watercraft according to claim 9, wherein the oil tank is provided with an inner tube inside of the oil tank in which water from the water jet pump flows.

11. The jet-propulsion watercraft according to claim 6, wherein the jet-propulsion watercraft is a personal watercraft configured such that a straddle-type seat is provided to span between a center portion of a body and a rear portion of the body, a steering handle is provided in front of the seat, and the engine is mounted in a space below the seat.

12. A jet-propulsion watercraft comprising:

an engine a tubular oil tank, said oil tank containing an inner tube as a cooling water passage, said inner tube containing a breather pipe therein, said breather pipe connected to an oil reserving portion formed between the inner tube and an inner face of the oil tank; and a water jet pump driven by the engine, the water jet pump pressurizing and accelerating water taken in from outside of the watercraft and ejecting the water from the outlet port to propel the watercraft as a reaction of the ejecting water, wherein the engine oil reserved in the oil tank is cooled by water being supplied from the water jet pump to the cooling water passage.

13. The jet-propulsion watercraft according to claim 12, wherein the base end of the breather pipe is located at an upper end portion of the oil tank, and the breather pipe extends downwardly to a bottom of the inner tube, from which the breather pipe extends upwardly, and a tip end of the breather pipe protrudes from an upper end of the oil tank.

* * * * *

UNITED STATES PATENT AND TRADEMARK OFFICE

CERTIFICATE OF CORRECTION

PATENT NO. : 6,840,829 B2 
DATED : January 11, 2005
INVENTOR(S) : Yoshimoto Matsuda et al.

It is certified that error appears in the above-identified patent and that said Letters Patent is hereby corrected as shown below:

Title page,
Item [63], Related U.S. Application Data, delete "November 1, 2002" and insert -- July 29, 2002 --.

Signed and Sealed this

Twenty-fourth Day of May, 2005

JON W. DUDAS
*Director of the United States Patent and Trademark Office*

UNITED STATES PATENT AND TRADEMARK OFFICE

CERTIFICATE OF CORRECTION

PATENT NO. : 6,840,829 B2
APPLICATION NO. : 10/232201
DATED : January 11, 2005
INVENTOR(S) : Yoshimoto Matsuda et al.

It is certified that error appears in the above-identified patent and that said Letters Patent is hereby corrected as shown below:

Claim 3, column 8, line 35, delete "3" and insert -- 2 --.

Signed and Sealed this

Fifteenth Day of January, 2008

JON W. DUDAS
*Director of the United States Patent and Trademark Office*